US005306525A

United States Patent [19]

Semura et al.

[11] Patent Number: 5,306,525

[45] Date of Patent: Apr. 26, 1994

[54] METHOD OF PROCESSING ROD

[75] Inventors: Yasuki Semura; Hiroshi Ando; Nobuyuki Nagahashi, all of Atsugi, Japan

[73] Assignees: Kabushiki Kaisha Komatsu Seisakusho; Komatsu Zenoah Kabushiki Kaisha, both of Tokyo, Japan

[21] Appl. No.: 938,251

[22] PCT Filed: Apr. 15, 1991

[86] PCT No.: PCT/JP91/00492

§ 371 Date: Oct. 15, 1992

§ 102(e) Date: Oct. 15, 1992

[87] PCT Pub. No.: WO91/16473

PCT Pub. Date: Oct. 31, 1991

[30] Foreign Application Priority Data

Apr. 25, 1990 [JP] Japan ..... 2-107347
Jul. 3, 1990 [JP] Japan ..... 2-174520

[51] Int. Cl.[5] ..... B05D 1/32; B05D 1/36; B05D 5/00

[52] U.S. Cl. ..... 427/259; 205/122; 205/210; 205/222; 427/270; 427/271; 427/304; 427/307; 427/443.1

[58] Field of Search ..... 205/112, 118, 122, 210, 205/221, 222, 223; 427/258, 259, 270, 271, 304, 305, 306, 307, 309, 443.1, 443.2

[56] References Cited

U.S. PATENT DOCUMENTS 2,847,370 8/1958 Howard et al. ..... 205/120
5,141,623 8/1992 Cohen et al. ..... 205/221 X
5,199,487 4/1993 DiFrancesco et al. ..... 205/73 X

FOREIGN PATENT DOCUMENTS 1-263292 10/1989 Japan .
1-306576 12/1989 Japan .

*Primary Examiner*—Michael Lusignan
*Attorney, Agent, or Firm*—Flynn, Thiel, Boutell & Tanis

[57] ABSTRACT

A method of processing the surface of a metallic rod, wherein coating films (2, 22 and 32) are applied onto portions other than the shape where grooves are to be formed on the surface of the rod, the surfaces of the rods (1, 21 and 31) which are not coated are dissolved and processed by chemical polishing or etching, whereby patterns of very shallow grooves (6, 24 and 34) are formed on the surface of the rod, so that making of grooves on the surface of a very heavy rod, a long rod and a curved rod, which have been considered difficult by the conventional machining, can be easily and accurately carried out. Furthermore, after the making of the grooves, the surface of a rod (41) is plated in a state (42) of being coated by photoresist films and screens, whereby the grooves and the recessed portions (43) are plated (44), and thereafter, the coating films (42) are removed by buffing (45) and the like and the plated surface is finished, thus effectively plating the grooves and the recessed portions.

1 Claim, 7 Drawing Sheets

METHOD OF PROCESSING ROD

TECHNICAL FIELD

The present invention relates to a method of processing the surface of a metallic rod and is particularly effectively adapted for making grooves on the surface of the metallic rod so as to form patterns thereon (circular grooves, straight grooves, and other various shaped grooves) which are used for a marking and a scale representing the position of the metallic rod of industrial machines and a decoration thereof.

The present invention also relates to a method of plating and polishing grooves after the making of the grooves on the surface of the metallic rod and is adapted for processing patterns which are used for a mark, a scale etc. of industrial machines, industrial vehicles, construction machines, etc.

BACKGROUND TECHNOLOGY

Machining (lathe turning or milling) has been conventionally employed as a method of patterning or making grooves on the surface of a metallic rod.

However, the metallic rod usually has a curved portion which is enlarged when the curved portion is subjected to a heat treatment etc.

Furthermore, since the rod is not always perfectly circular in its cross section but it may be elliptical or eccentric, machining such rods, heavy rods and long rods, uniforming the depth of the grooves and processing the rod with high accuracy are difficult, which involves high cost.

The present invention has improved the drawback of the conventional processing method and is to provide a method of processing the rod capable of forming patterns of very shallow grooves on the surface of the rod etc. with ease and high accuracy.

DISCLOSURE OF THE INVENTION

The present invention has been made to solve the problems set forth above and comprises the steps of forming coating films having necessary shapes on the surface of the rod and then removing the coating films on the necessary portion where the patterns are formed in the necessary shape or on the portions other than the necessary portion so as to print the patterns, by a photoresist method, a tape masking method or a screen printing method.

Furthermore, it is possible to make the patterns of shallow grooves on the surface of the rod by subjecting the surface of the rod having no coating films thereon to a chemical polishing or etching for dissolving and processing the same.

The photoresist is a material for forming a chemical-resistant coating film, and particularly an insoluble hard coating film which is formed of gelatin or polyvinyl alcohol including dichromate, diazo compound.

The tape masking method is to wind a tape on the surface of the rod. The tape is formed of a material which is not removed by the etching.

The screen printing method is to print a screen, which is for use in photoengraving, on the surface of the rod.

Still furthermore, according to the present invention, the circular or the straight grooves or the grooves having various shapes are formed respectively on the surface of the rod by applying the films onto the portion other than the necessary shape where the grooves are to be formed on the surface of the rod by the photoresist method, the tape masking method or the screen printing method. Thereafter, the surface of the rod is plated in a state of being coated by photoresist films or screens whereby the grooves or the recessed portions are plated. Thereafter, the coating films are removed by buffing and the like and the plated surface is finished, thus the number of steps of processes are reduced and the plating quality is improved.

Since the grooves and the recessed portions are double plated by plating the surface of the rod, the rust preventive effect can be improved, particularly, when a hard chromium plating is made on the surface of the rod.

BEST MODE FOR CARRYING OUT THE INVENTION

An embodiment of the present invention will be described with reference to drawings.

Figure 1B:
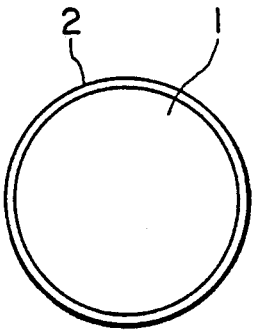
FIGS. 1(*a*) and 1(*b*)
Figure 1A:
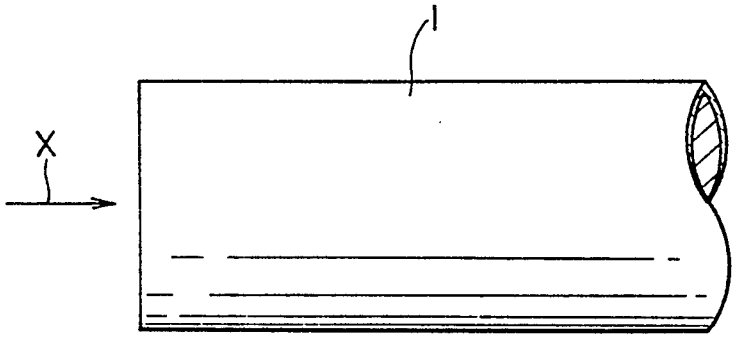
Figure 2B:
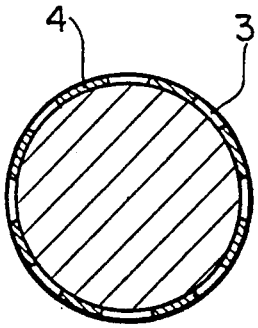
FIGS. 2(*a*) and 2(*b*)
Figure 2A:
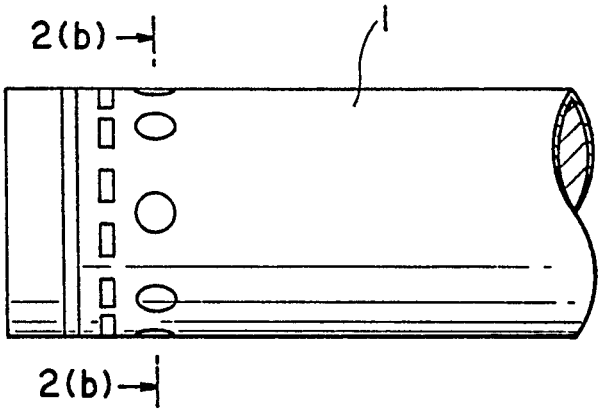
Figure 3B:
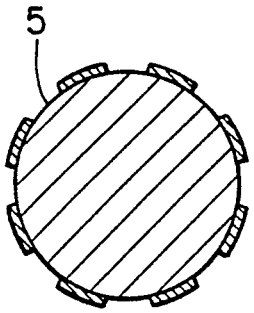
FIGS. 3(*a*) and 3(*b*)
Figure 3A:
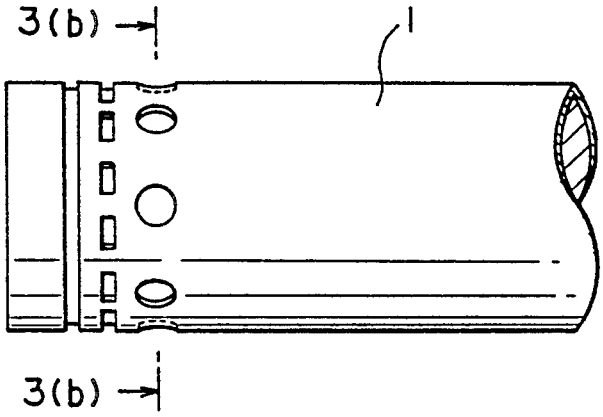
Figure 4B:
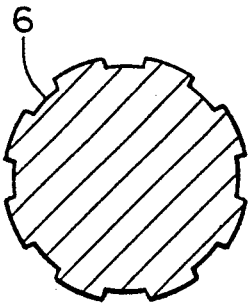
FIGS. 4(*a*) and 4(*b*) show respectively a method of processing a rod by a photoresist method, FIGS. 5(*a*) and 5(*b*)
Figure 4A:
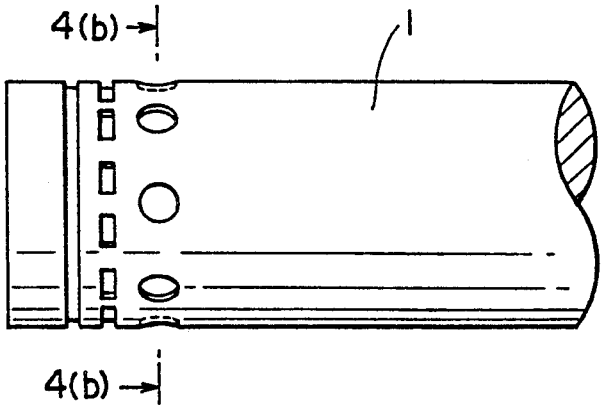

FIGS. 1(*a*) and (*b*) to FIGS. 4(*a*) and (*b*) show respectively a method of processing a rod by a photoresist method wherein FIG. 1(*b*) is a perspective view as viewed from an arrow X in FIG. 1(*a*), FIG. 2(*b*) is a cross-sectional view taken along lines A—A in FIG. 2(*a*), FIG. 3(*b*) is a cross-sectional view taken along line B—B in FIG. 3(*a*) and FIG. 4(*b*) is a cross-sectional view taken along line C—C in FIG. 4(*a*). In these figures, a photoresist coating film 2 is applied onto the surface of a rod 1 and portions as denoted at 4 other than necessary portions 3 to be patterned are exposed to light and hardened. Thereafter, the rod is cleansed to thereby wash out the non-exposed portions of the rod, which are denoted at 5 in FIG. 3(*b*). Successively, the portions denoted at 5 from which the coating film is washed out is subjected to chemical polishing so that desired shallow grooves are formed on the surface of the rod as denoted at 6 in FIG. 4(*b*).

Figure 5B:
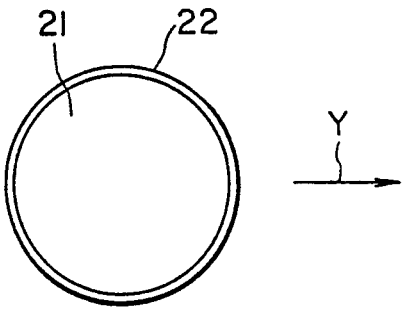
Figure 5A:
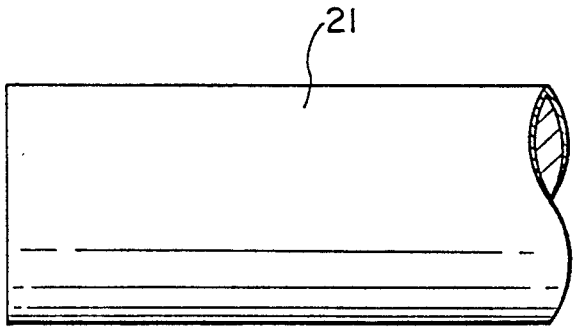
Figure 6B:
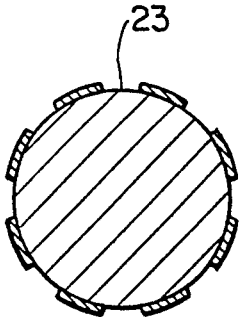
FIGS. 6(*a*) and 6(*b*)
Figure 6A:
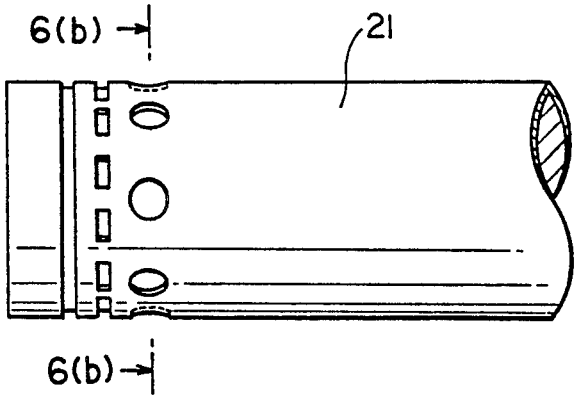
Figure 7B:
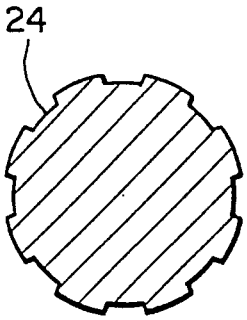
FIGS. 7(*a*) and 7(*b*) show respectively a method of processing a rod by a tape masking method and FIGS. 8(*a*) and (*b*) and FIGS. 9(*a*) and (*b*) show respectively a method of processing a rod by a screen printing method.
Figure 7A:
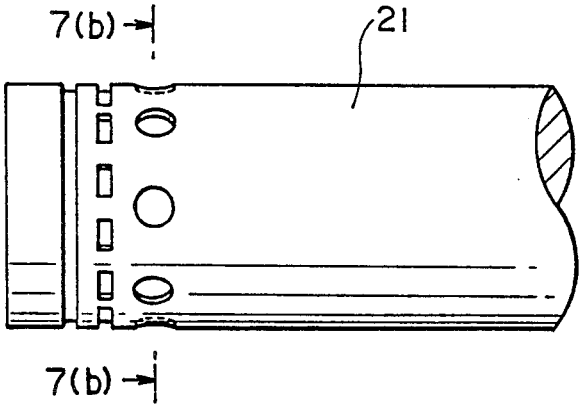

FIGS. 5(*a*) and (*b*) to FIGS. 7(*a*) and (*b*) show respectively a method of processing a rod by a tape masking method wherein FIG. 5(*b*) is a perspective view as viewed from an arrow Y in FIG. 5(*a*), FIG. 6(*b*) is a cross-sectional view taken along line D—D in FIG. 6(*a*), FIG. 7(*b*) is a cross-sectional view taken along line E—E in FIG. 7(*a*). In these figures, a masking tape 22 is wound around the surface of a rod 21 and necessary portions to be patterned as denoted at 23 in FIG. 6(*b*) are removed by a cutter and thereafter the surface of the rod from which the tape is removed is subjected to the chemical polishing whereby desired shallow grooves are formed on the surface of the rod as denoted at 24 in FIG. 7(*b*).

Finally when the remaining masking tape is removed from the surface of the rod 21, the processing is completed.

Figure 8B:
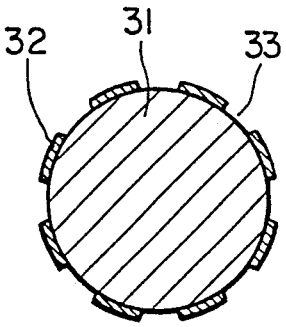
Figure 8A:
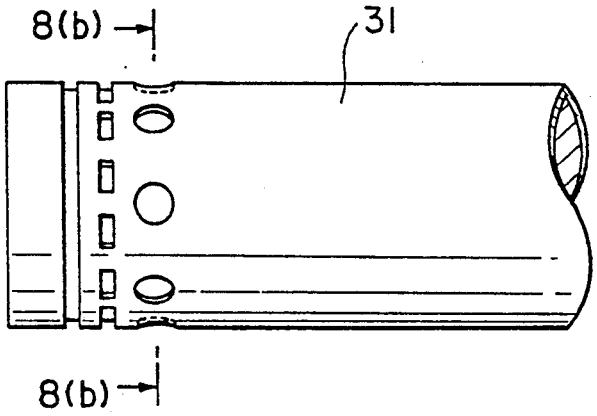
Figure 9B:
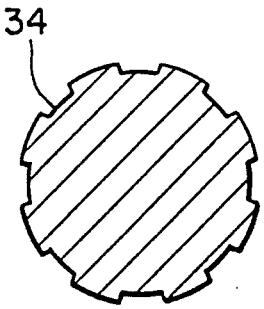
Figure 9A:
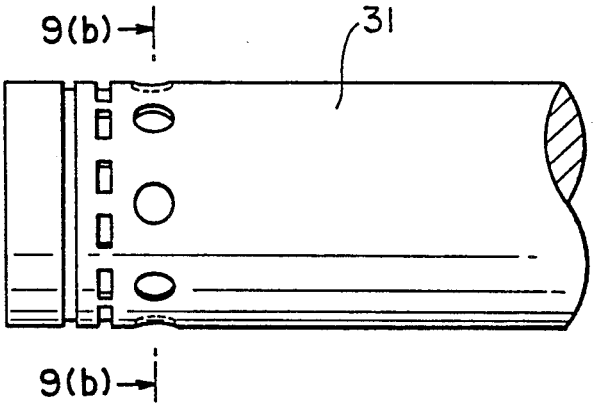

FIGS. 8(*a*) and (*b*) and FIGS. 9(*a*) and (*b*) show respectively a method of processing a rod by a screen printing method wherein FIG. 8(*b*) is a cross-sectional view taken along line F—F in FIG. 8(*a*), FIG. 9(*b*) is a cross-sectional view taken along line G—G in FIG. 9(*a*). In these figures, a screen printing is performed on the surface of a rod 31 other than necessary portions to be patterned as denoted at 32.

Denoted at 33 is portions where no screen printing is performed.

The portions 33 where no screen printing is performed is subjected to the chemical polishing to thereby form the desired shallow grooves as denoted at 34 in FIG. 9(*b*).

Finally when the remaining screen is removed from the surface of the rod, the processing is completed.

Figure 10B:
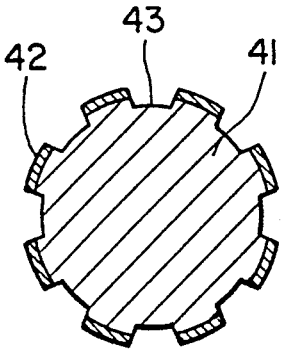
FIGS. 10(*a*) and (*b*) show an example of the surface of the rod which has grooves formed by one of the methods as illustrated in FIGS. 1(*a*) and (*b*) to FIGS. 9(*a*) and (*b*), and FIGS. 11(*a*) and 11(*b*); 12(*a*) and 12(*b*)
Figure 10A:
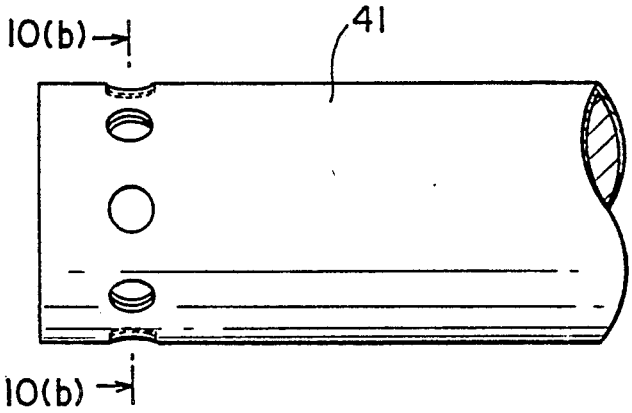

FIGS. 10(*a*) and (*b*) show the step of forming the pattern of grooves wherein the portion other than the portion where the patterns of grooves are to be formed are coated by films and the portions which are not coated by the films are subjected to the chemical polishing or etching to thereby form the pattern of the shallow grooves on the surface of the rod. FIG. 10(*b*) is a cross-sectional view taken along line H—H.

This coating film is normally formed on the surface of the rod by the aforementioned photoresist method, the tape masking method or the screen printing method.

In FIG. 10(*b*), denoted at 41 are a rod, 42 are coating films and 43 are grooves which are formed by etching the surface of the rod.

Figure 11B:
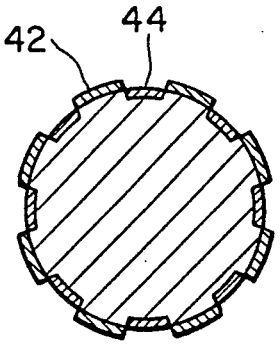
Figure 11A:
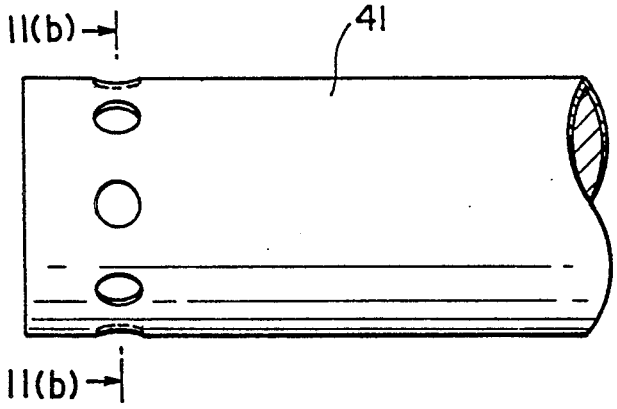

FIGS. 11(*a*) and (*b*) show the rod 41 having the thus processed grooves 43 which are subjected to plating without removing the coating film 42 therefrom. FIG. 11(*b*) is a cross-sectional view taken along line I—I in FIG. 11(*a*). Denoted at 44 is portions which are subjected to plating.

Since the grooves 43 have course surfaces due to the etching and chemical polishing, they are excellent in being subjected to plating.

Furthermore, since a current density is high in convex portions, the grooves or the recessed portions are not liable to be plated. Accordingly, the grooves or the recessed portions are subjected to the plating while the surface of the rod 41 is kept to be coated by the films 42.

In case of plating the surface of the rod after the grooves or the recessed portions are formed on the surface of the rod by the photoresist method, the tape masking method or the screen printing method, the plating can be performed after the coating film is removed. In this case, a shot blasting or a solution can be used as a method of removing the coating. However, when the coating film is removed by using the shot blasting or the solution, the smoothness of the surface of the rod is deteriorated or the surface becomes rough. Accordingly, the plating after the removal of the coating film gives a bad influence upon the adherence of the plating on the surface of the rod.

Whereupon, according to the embodiment of the present invention, the grooves or the recessed portions are subjected to the plating while they are coated by the films as set forth above, the quality of the plating can be improved.

Figure 12B:
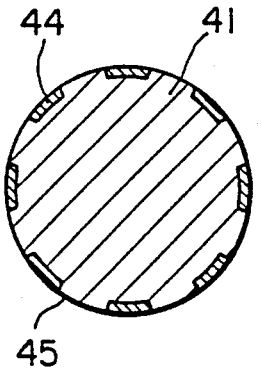
Figure 12A:
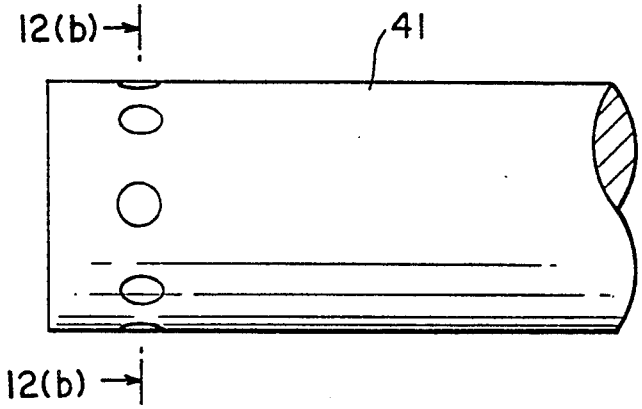

FIGS. 12(*a*) and (*b*) show steps following the steps as illustrated in FIGS. 11(*a*) and (*b*) wherein the coating films 42 are removed from the peripheral surface of the rod 41 in a state of being subjected to the plating as illustrated in FIG. 11(*b*) by buffing and the like and thereafter the surface of the rod and the plated surface are respectively polished as denoted at 45 to thereby complete the surface treatment.

FIG. 12(*b*) is a cross-sectional view taken along line K—K in FIG. 12(*a*).

In FIGS. 12(*a*) and (*b*), since the surface of the rod has the same height as that of the plated surface of the grooves, it is possible to process the surface of the rod without alternately repeating the processes of plating→polishing→plating→polishing.

It is possible to form various patterns of different materials on the surface of the rod or to bury different materials therein.

Figure 13B:
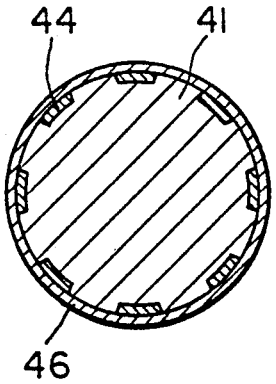
FIGS. 13(*a*) and 13(*b*) show each step of processes for plating and polishing the grooves in succession after the grooves are formed.
Figure 13A:
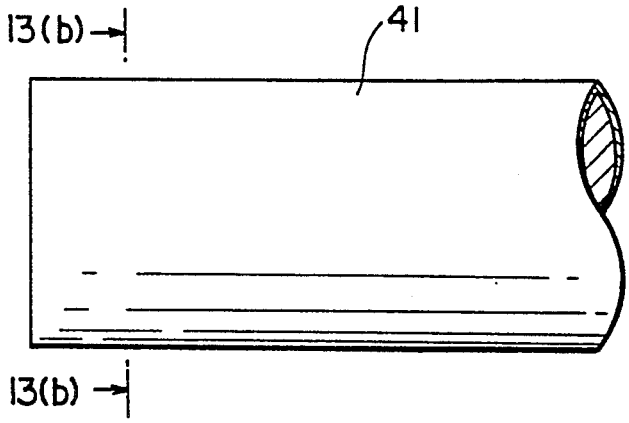

A surface 45 of the rod 41 in FIGS. 12(*a*) and (*b*) may be subjected to the plating 46 as illustrated in FIGS. 13(*a*) and (*b*), if need be. With such a process, patterns 44 in FIGS. 12(*b*) and 13(*b*) on the grooves or the recessed portions are double plated so that the rust preventive effect can be more improved at the grooves which are hardly to be plated, particularly if they are plated by the hard chromium plating. FIG. 13(*b*) is a cross-sectional view taken along line L—L in FIG. 13(*a*).

INDUSTRIAL UTILIZATION

As mentioned in detail above, there is such an excellent effect that the patterns of very shallow grooves or the grooves are formed on the surface of the heavy rod, the long rod and the curved rod with ease, high accuracy and low cost, which has been considered difficult by the conventional machining.

Furthermore, it is possible to effectively plate the grooves or the recessed portions, which have been considered difficult primarily, by plating these grooves or the recessed portions beforehand.

Since the height of the surface of the rod is the same as that of the plated surface on the grooves, it is possible to process the surface of the rod without alternately repeating the processes of plating→polishing→plating→polishing.

Still furthermore, it is possible to remove the coating films and at the same time polish the plated surface by buffing after the grooves are plated. It is possible to subject the grooves to the double plating by further plating the surface of the rod upon completion of the polishing, if need be, particularly to improve the rust preventive effect at the grooves which are plated by the hard chromium plating.

According to the method of the present invention, it is possible to reduce the number of steps of the processes and to process the grooves of the rod with high plating quality.

We claim:

1. A method of processing the surface of a rod, comprising the steps of:

applying a film onto a portion of the surface where a recessed portion is not to be formed, leaving a portion of the surface exposed where a recessed portion is to be formed;

removing material from the exposed portion of the surface of the rod so as to form a recessed portion in the surface;

plating the surface of the rod while said film remains thereon so as to plate the recessed portion to a level corresponding to the surface of the rod, thereby filling the recessed portion with plated material;

removing said film from the surface of the rod, whereby an unplated portion is provided on the surface of the rod; and finishing the plated recessed portion and unplated surface portion of the rod.

* * * * *